US005687863A

United States Patent [19]

Kusz

[11] Patent Number: 5,687,863

[45] Date of Patent: Nov. 18, 1997

[54] SQUEEZE AND TURN CHILD RESISTANT PACKAGE

[75] Inventor: Maximillian Kusz, Waterville, Ohio

[73] Assignee: Owens-Illinois Closure Inc., Toledo, Ohio

[21] Appl. No.: 594,095

[22] Filed: Jan. 30, 1996

[51] Int. Cl.[6] ..... B65D 50/08

[52] U.S. Cl. ..... 215/216; 215/219; 215/331

[58] Field of Search ..... 215/330, 331, 215/334, 216–223, 214, 44; 220/298, 301

[56] References Cited

U.S. PATENT DOCUMENTS

| | | |
|---|---|---|
| D. 103,049 | 2/1937 | Higgins . |
| D. 135,803 | 6/1943 | Loewy . |
| D. 201,584 | 7/1965 | Shepler . |
| D. 298,514 | 11/1988 | Dole et al. . |
| D. 330,677 | 11/1992 | Thornock et al. . |
| 2,168,594 | 8/1939 | Till . |
| 3,101,856 | 8/1963 | Whiteman, Jr. . |
| 3,182,843 | 5/1965 | Foye . |
| 3,185,333 | 5/1965 | Sharp . |
| 3,200,979 | 8/1965 | Powers . |
| 3,233,769 | 2/1966 | Jessop . |
| 3,261,513 | 7/1966 | Moran . |
| 3,399,796 | 9/1968 | Steiner . |
| 3,445,022 | 5/1969 | Cilluffo . |
| 3,603,470 | 9/1971 | Armour . |
| 3,656,666 | 4/1972 | Taylor . |
| 3,703,975 | 11/1972 | Wittemer . |
| 3,770,153 | 11/1973 | Gach et al. . |
| 3,777,924 | 12/1973 | Kayser et al. . |
| 3,792,793 | 2/1974 | Rose . |
| 3,841,514 | 10/1974 | Montgomery et al. . |
| 3,844,438 | 10/1974 | St. Pierre et al. . |
| 3,870,182 | 3/1975 | Georgi . |
| 3,881,624 | 5/1975 | Dougherty, Sr. . |
| 3,892,325 | 7/1975 | Maguire . |
| 3,896,335 | 7/1975 | Bogert . |
| 3,917,097 | 11/1975 | Uhlig . |
| 3,917,098 | 11/1975 | Acton et al. . |
| 3,941,268 | 3/1976 | Owens et al. . |
| 3,949,893 | 4/1976 | Montgomery . |
| 3,958,708 | 5/1976 | Le Brun, Jr. . |
| 3,984,021 | 10/1976 | Uhlig . |
| 3,989,152 | 11/1976 | Julian . |
| 3,993,208 | 11/1976 | Ostrowsky . |
| 3,993,209 | 11/1976 | Julian . |
| 4,093,096 | 6/1978 | Augros . |
| 4,117,945 | 10/1978 | Mumford . |
| 4,134,513 | 1/1979 | Mumford . |
| 4,138,028 | 2/1979 | Price et al. . |
| 4,149,646 | 4/1979 | Julian . |
| 4,172,533 | 10/1979 | Montgomery . |
| 4,213,534 | 7/1980 | Montgomery . |

(List continued on next page.)

FOREIGN PATENT DOCUMENTS

| | | | |
|---|---|---|---|
| 10028 | 4/1980 | European Pat. Off. | 215/331 |
| 0443868 | 8/1991 | European Pat. Off. . | |
| 3919578 | 11/1990 | Germany | 215/217 |

*Primary Examiner*—Allan N. Shoap
*Assistant Examiner*—Nathan Newhouse

[57] ABSTRACT

A squeeze and turn child resistant package including a container having a finish and a closure having a base wall and an outer peripheral flexible wall depending from the base wall. The wall has an internal thread on the inner surface thereof, the finish has an external thread thereon. The closure has an internal surface with spaced flexible chordal lugs extending circumferentially in the direction of removal of the closure. The container finish has opposed radially extending abutments. Each abutment includes a radial abutting surface. The finish of the container includes an integral radial projection adjacent the radial abutting surface of the abutment which has a lesser radial extent than the abutment. The radial projection has a chordal surface extending to the intersection of the radial abutting surface on he finish such that the chordal lug on the closure is forced toward the intersection when a closure is rotated in a retrograde direction to remove the closure without flexing the peripheral wall. The finish has stops below the threads engaging a blunt end leading end of the thread on the closure to limit the movement of the closure and orient the closure.

15 Claims, 4 Drawing Sheets

U.S. PATENT DOCUMENTS 4,238,042 12/1980 Hatakeyama et al. ..... 215/334
4,270,664 6/1981 Buono .
4,273,248 6/1981 Lehamann ..... 215/334 X
4,280,631 7/1981 Lohrman .
4,289,248 9/1981 Lynn .
4,299,339 11/1981 Giroux et al. .
4,310,101 1/1982 Sekine .
4,335,823 6/1982 Montgomery .
4,345,690 8/1982 Hopley ..... 215/216
4,351,443 9/1982 Uhlig .
4,376,497 3/1983 Mumford .
4,383,618 5/1983 Dougherty .
4,410,097 10/1983 Kusz .
4,452,363 6/1984 Davis .
4,535,906 8/1985 Rowekamp ..... 215/334 X
4,588,097 5/1986 Hauser .
4,662,530 5/1987 Goncalves et al. .
4,723,669 2/1988 Barriac .
4,752,013 6/1988 Miller et al. .
4,770,308 9/1988 Lynn .
4,832,220 5/1989 Quennessen ..... 215/331
4,865,209 9/1989 Bush .
4,948,002 8/1990 Thornock et al. .
5,078,288 1/1992 Fuchs .
5,145,080 9/1992 Imbery, Jr. .
5,184,741 2/1993 Chevassus et al. .
5,186,369 2/1993 Aguirrezabal .
5,213,225 5/1993 King et al. .
5,230,433 7/1993 Hamilton et al. .
5,238,130 8/1993 Marques et al. .

SQUEEZE AND TURN CHILD RESISTANT PACKAGE

This invention relates to child resistant packages and particularly to such packages which are of the squeeze and turn type.

BACKGROUND AND SUMMARY OF THE INVENTION

In typical squeeze and turn child resistant packages, it is common to provide a container having opposed stop lugs and a closure which has lugs on the periphery thereof which engage the stop lugs on the container. To remove the closure, it must be squeezed to permit the lugs on the closure to be moved out of the path of the lugs on the container and the closure can then be unthreaded from the container. Typical patents showing such a construction are U.S. Pat. Nos. 3,949,893; 3,894,021; 4,116,351 as well as EPO WO 9/01924.

Such child resistant packages have been produced and have been successful in the marketplace. However, they sometimes are difficult to use. When efforts are made to make such packages easier to use and more user friendly, the closure may be defeated if the lugs on the closure are bent backward and the closure is rotated in an unthreading direction (counter clockwise), even though the closure has not been squeezed.

Accordingly, among the objectives of the present invention are to provide a child resistant package which is readily usable by an adult; more user friendly; and which can not be readily defeated.

In accordance with the invention, the squeeze and turn child resistant package comprises a container having a finish and a closure having a base wall and an outer peripheral flexible wall or skirt depending from the base wall. The wall has an internal thread on the inner surface thereof. The finish has an external thread thereon. The closure has an internal surface with spaced flexible chordal lugs extending circumferentially in the direction of removal of the closure. The container finish has opposed radially extending abutments, each abutment including a radial abutting surface. The finish of the container includes an integral radial projection adjacent the radial abutting surface of the abutment which has a lesser radial extent than the abutment. The radial projection also has a chordal surface extending to the intersection of the radial abutting surface on the finish such that the chordal lug on the closure is forced toward the intersection when a closure is rotated in a retrograde direction (counter clockwise) to remove the closure without flexing the peripheral wall. The finish also has stops below the threads engaging a blunt leading end of the thread on the closure to limit the rotation of the closure with respect to the container and orient the closure on the container.

DESCRIPTION OF THE PREFERRED EMBODIMENTS

Referring to FIGS. 1–12, the squeeze and turn child resistant package 20 embodying the invention comprises a container 22 and a closure 24. The container 22 is made of plastic such as polypropylene or polyethylene terpthalate and the closure is made of plastic, preferably polypropylene.

Figure 4:
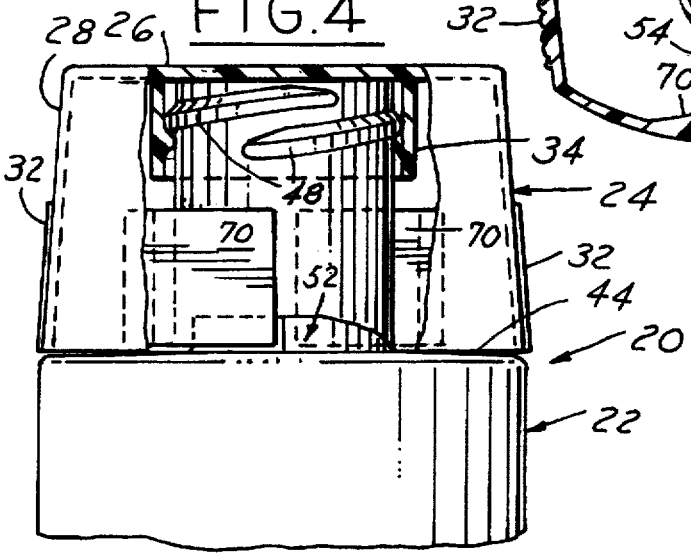
FIG. 4 is a fragmentary part sectional elevational view of a portion of the package.
Figure 5:
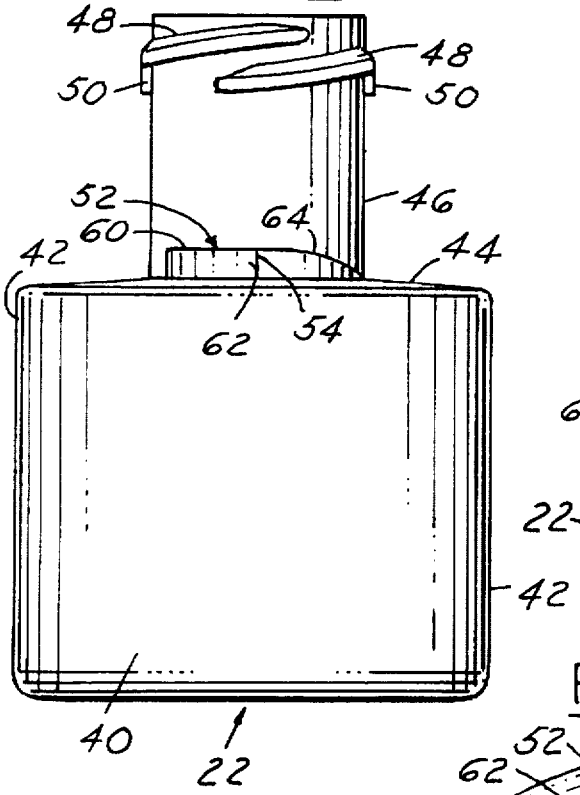
FIG. 5 is an elevational view of the container.

The closure 24 includes a base wall 26 and a peripheral wall or skirt 28 which is generally oval in cross section having a long axis and a short axis. Opposed flat finger engaging portions 30 are provided at the long axis (FIGS. 2, 9) and have vertical ribs 32 to facilitate grasping between the thumb and the finger. The closure further includes an inner annular wall skirt 34 having dual threads 36 (FIG. 4, 11). The leading end of each of the threads 36 on the closure is a blunt end, 38 for purposes presently described.

Figure 6:
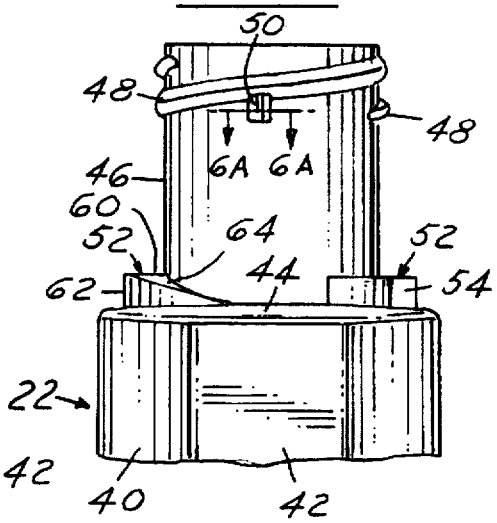
FIG. 6 is a side elevational view of a container taken from the right in FIG. 5.
Figure 7:
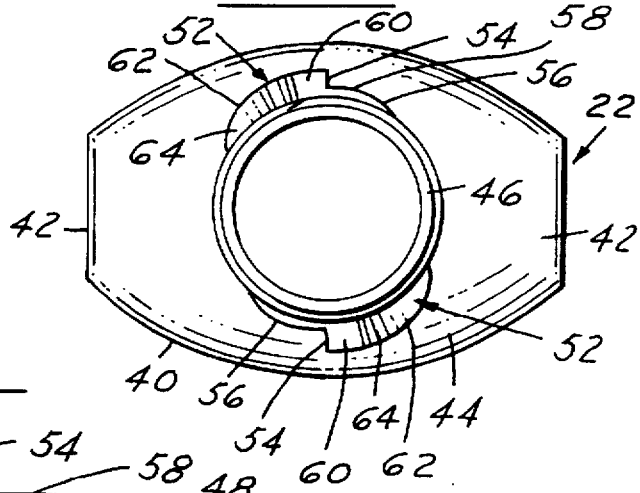
FIG. 7 is a plan view of the container shown in FIG. 5.
Figure 9:
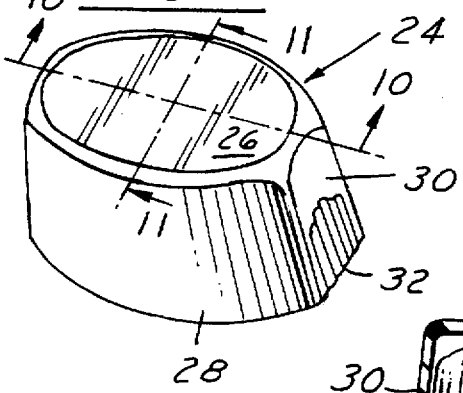
FIG. 9 is a perspective view of the closure.
Figure 10:
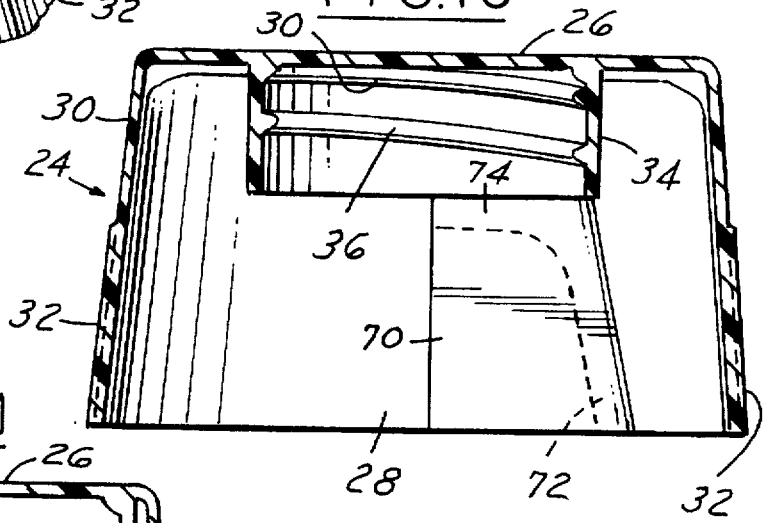
FIG. 10 is a sectional view taken along the line 10—10 in FIG. 9.
Figure 11:
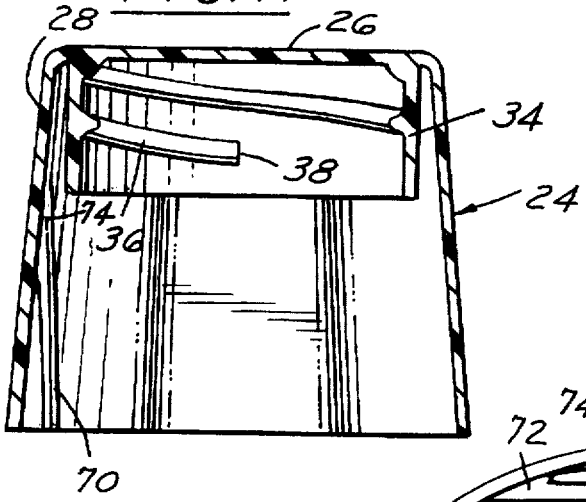
FIG. 11 is a sectional view taken along the line 11—11 in FIG. 9.
Figure 12:
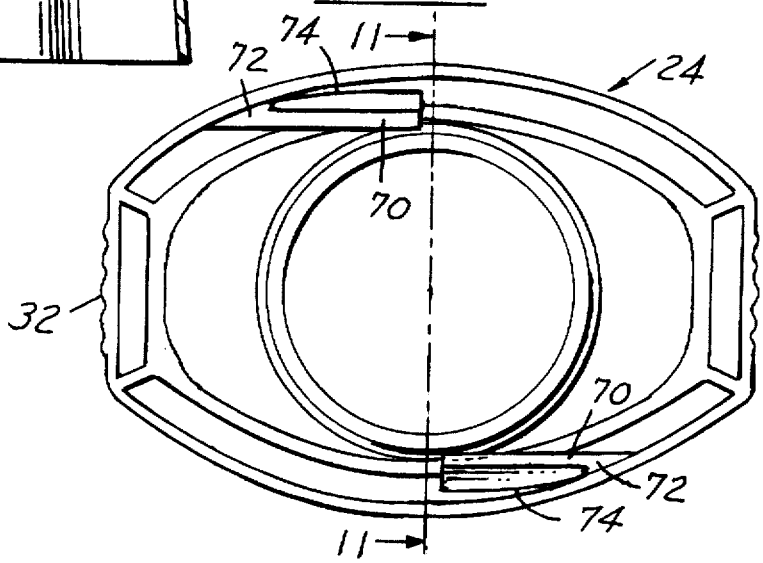
FIG. 12 is a bottom plan view of the closure.
Figure 13:
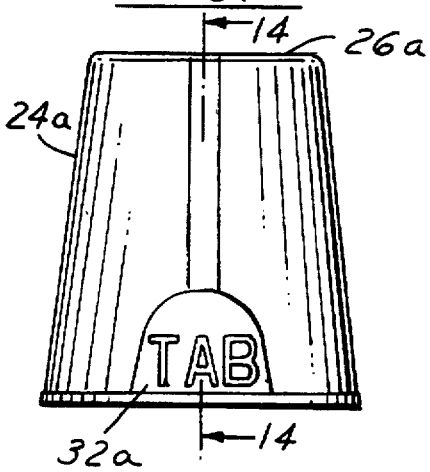
FIG. 13 is an elevational of a modified form of closure.
Figure 15:
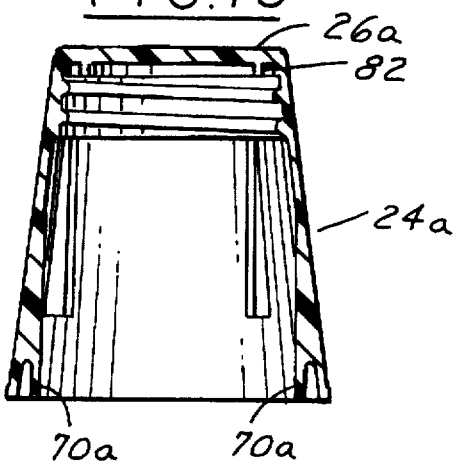
FIG. 15 is a sectional view taken along the line 15—15 in FIG. 14.
Figure 14:
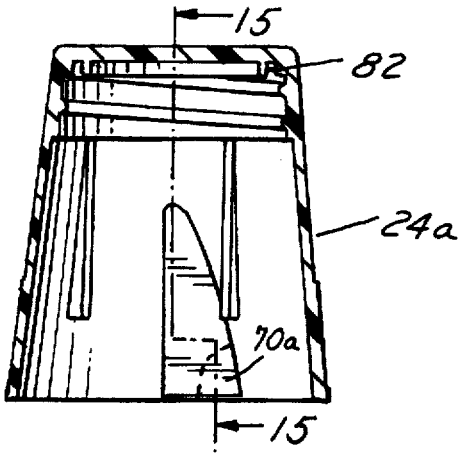
FIG. 14 is a sectional view taken along the line 14—14 in FIG. 13.
Figure 16:
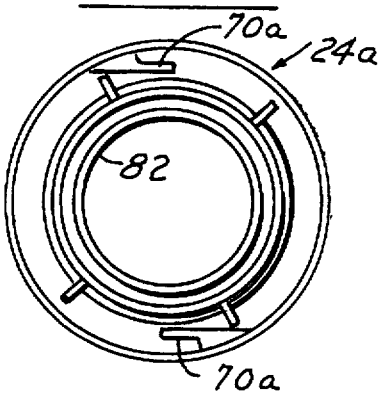
FIG. 16 is a bottom plan view of the closure shown in FIG. 14.
Figure 17:
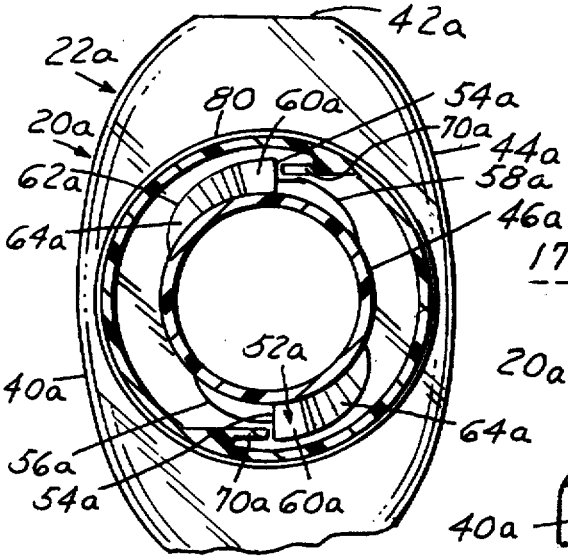
FIG. 17 is a sectional view of the closure shown in FIGS. 13–16 as applied to a container.
Figure 18:
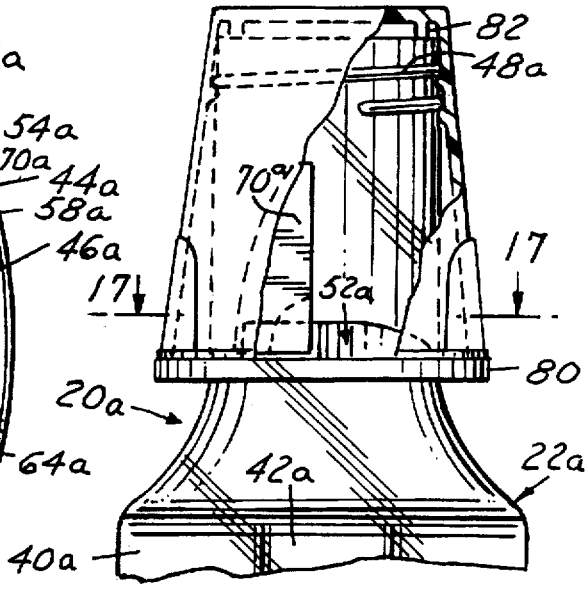
FIG. 18 is a fragmentary part sectional elevational view of the package shown in FIG. 17.

Referring to FIGS. 7 and 9, the container 22 is generally oval in horizontal cross section corresponding to the horizontal cross section of the closure 24 so when the closure is fully applied, the profiles of the closure 24 and container 22 conform. Thus, the container 22 has arcuate sides 40 and flat oppose sides 42 (FIG. 7). The container 22 further includes a shoulder 44 with a cylindrical finish 46 extending upwardly therefrom. The finish 46 has threads 48 complementary to the threads 36 on the closure 24. In addition an axial stop 50 is provided on each of the threads 48 and extends downwardly therefrom as shown in FIG. 6, for purposes presently described.

Figure 8:
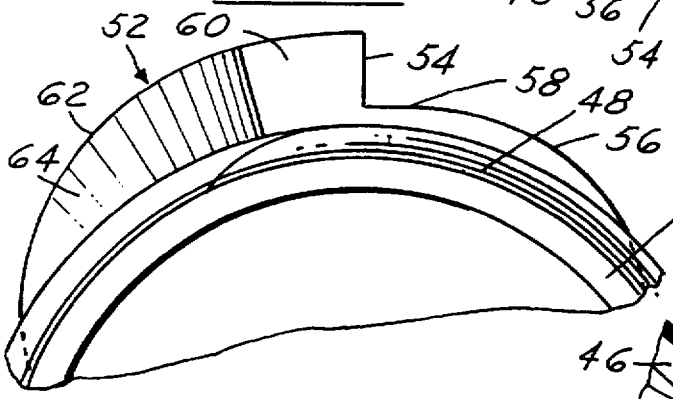
FIG. 8 is a fragmentary enlarged plan view of a portion of the container.

Referring to FIGS. 7 and 8, the finish 46 is formed with radially opposed abutments 52, each of which has a radially extending and axially extending surface 54. An upwardly and circumferentially extending radial projection 56 having a lesser radial extent than abutment 52 is provided adjacent the abutting surface 54 and includes a chordal surface 58 intersecting the abutting surface 54 at a right angle. Abutment 52 includes a flat upper radial surface 60 intersecting the axial surface 54. Abutment 52 further includes a circumferentially extending projection 62 which extends circumferentially from the axial surface 54 in a direction opposite to projection 56. Projection 62 has an upper inclined surface 64 extending in the direction of rotation of the closure 24 which the closure 24 is applied to the container 22.

The closure 24 includes opposed flexible chordal lugs 70 on arcuate walls 28. Each chordal lug 70 extends circumferentially in the direction of the removal of the closure and is hinged to the skirt along a vertical hinge area 72 and at its upper end on a horizontal hinge area 74 (FIGS. 2, 4, 11, 12).

Figure 1:
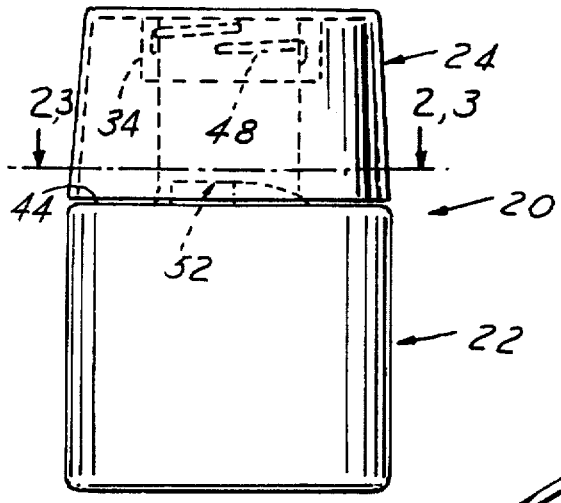
FIG. 1 is an elevational view of a child resistant package embodying the invention.
Figure 2:
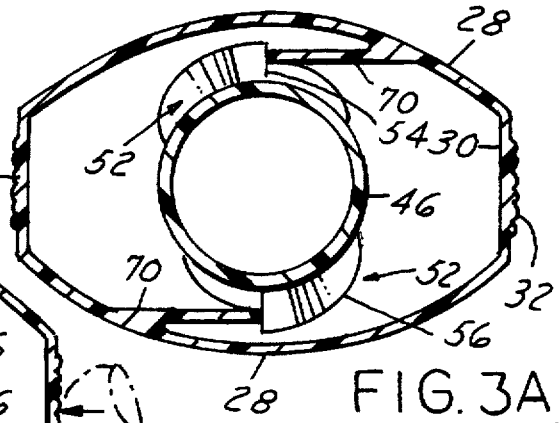
FIG. 2 is a sectional view taken along the line 2—2 in FIG. 1.
Figure 3:
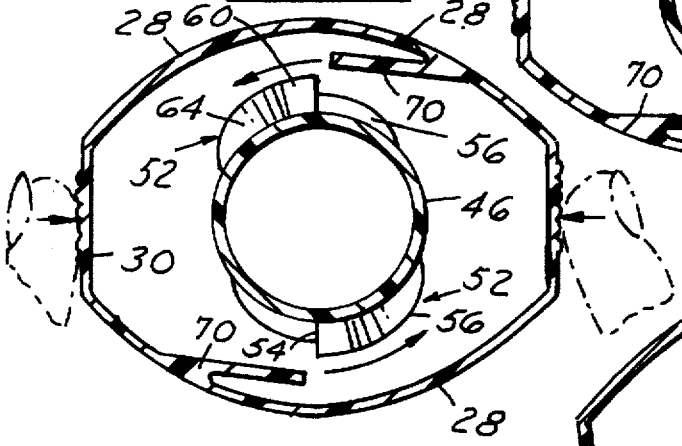
FIG. 3 is a view similar to FIG. 2 showing the relative positions of the closure and the container when the closure is being removed.
Figure 3A:
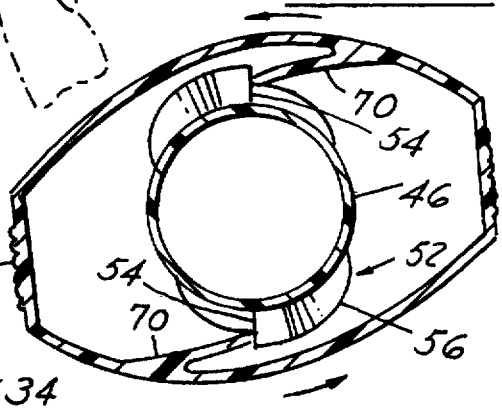
FIG. 3A is a view similar to FIG. 2 showing the relative positions of the closure and container when an attempt is made to remove the closure in without squeezing.

When the closure 24 is rotated to apply the closure to the container 22 the chordal lugs 70 engage the ramp surface 64 and flex past the abutments 52 to assume the position such as shown in FIG. 2 preventing the closure 24 from being unscrewed. When the closure is to be removed the wall 28 is squeezed at portions 30, as shown in FIG. 3, causing the chordal lugs 70 to be moved outwardly beyond the abutment surfaces 54 so that the closure 24 can be unthreaded. If an attempt is made to remove the closure without flexing the wall 28, the free edges of said chordal lugs 70 will engage the intersection of the axial abutting surface 54 on the finish 46 and the chordal surface 58 of radial projection 56 on the finish 46 causing the wall 28 to flex outwardly as shown in FIG. 3A and causing the chordal lugs 70 to change their angular relationship further forcing the ends of the chordal lugs 70 into the intersection.

Figure 6A:
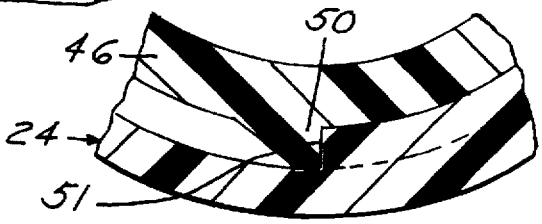
FIG. 6A is a fragmentary enlarged sectional view taken along the line 6A—6A in FIG. 6.

When the closure 24 is applied to the container 22 the blunt ends 38 on the threads of the closure 24 engage the stops 50 on the finish 46 (FIG. 6A). Each stop 50 includes a complementary axial surface 51 and thickened at its free end to strengthen the stop 50. This limits the rotation of the closure 24 and align the oval closure 24 with the oval container 22. At the same time the stops 50 prevent over tightening and facilitates the removal of the closure by an adult.

In the form of the invention shown in FIGS. 13–18 the package 22*a* includes a closure 24 is circular in cross section and there is no need for a blunt thread or stop on the container since the closure need not be oriented with respect to the container. However, it can be included if there is a desire to prevent over tightening. In this form, for purposes of clarity corresponding numbers are provided to corresponding parts with a suffix "a". The container includes a radial flange 80 immediately beneath the closure when the closure is fully applied. It may be further noted that the closure does not have an inner skirt but that the threads on the closure are applied directly to the outer skirt. An annular flange 82 extends downwardly from the base wall of the closure and engages the opening of the container to provide a valve seal which is particularly useful when the package is used for handling liquid products.

It can thus be seen that there has been provided a child resistant package which is readily usable by an adult; more user friendly; and which can not be readily defeated.

What is claimed is:

1. A squeeze and turn child resistant package comprising a plastic container having a finish with external threads means, a plastic closure having a base wall and an outer peripheral flexible wall depending from said base wall, said peripheral wall of said closure having an internal thread means thereon complementary to said thread means on said finish, said closure having opposed finger engaging portions on the outer surface of said peripheral flexible wall, said peripheral flexible wall of said closure having an internal surface with spaced flexible chordal lugs, each said chordal lug being attached along an axial area of said internal surface of said peripheral flexible wall, each said chordal lug being spaced circumferentially from each finger engaging portion, each said chordal lug having a free edge extending circumferentially in the direction of removal of the closure, each said axial area of each chordal lug being spaced intermediate a finger engaging portion and the free edge of said respective chordal lug, said container finish having diametrically opposed radially extending abutments spaced below said thread means, each said abutment having a radially and axially engaging abutting surface, said abutting surfaces being positioned circumferentially with respect to said finger engaging portions when said closure is fully applied on said finish, said finish of said container including an integral radial projection adjacent said radial abutting surface of said abutment, each said radial projection having a lesser radial extent than the associated abutment, each said radial projection including a chordal surface intersecting said abutting surface at a right angle, each said radial projection having a circumferential outwardly arcuate surface extending to the chordal surface, such that when the closure is rotated to apply the closure to the container, the chordal lugs flex past the abutments, and when fully applied, the free end of each said chordal lug is positioned adjacent the intersection of said abutting surface and said chordal surface of said radial projection preventing the closure from being unscrewed, such that when the closure is to be removed, the wall is squeezed at finger engaging portions causing the chordal lugs to be moved outwardly beyond the abutment surfaces so that the closure can be unthreaded, and such if an attempt is made to remove the closure without flexing the wall, the free edges of said chordal lugs will engage the intersection of the axial abutting surfaces on the finish and the chordal surfaces on the radial projections on the finish causing the wall to flex outwardly and causing the chordal lugs to change their angular relationship further forcing the ends of the chordal lugs into the intersection.

2. The squeeze and turn package set forth in claim 1 including interengaging stop means on said container and closure, such that when said closure is applied to the container, the stop means on said closure engages said stop means on said finish to limit rotation of the closure and prevent overtightening of the closure to facilitate removal of the closure by an adult.

3. The squeeze and turn package set forth in claim 2 wherein said interengaging stop means comprises blunt ends on the threads of said closure, said stop means on said finish including stops, each said stop including an axial surface such that when the closure is applied to the container, the blunt ends on the threads of the closure engage the stops on the finish to limit the rotation of the closure and prevent overtightening to facilitate the removal of the closure by an adult.

4. The squeeze and turn child resistant package set forth in claim 3 wherein said container has a non-circular body portion and said closure has a peripheral wall having a non-circular cross section corresponding to that of the body, said finish of the container having downwardly extending axial stops extending downwardly from the threads thereof, said closure having said blunt leading end on the threads thereof abutting said downwardly extending stops on the finish to orient the closure with respect to the container.

5. The squeeze and turn child resistant package set forth in claim 4 wherein the configuration of said body of said container and said skirt of said closure are generally oval and have a long axis and a short axis and opposed vertical flat surfaces on the long axis on the container and the closure, said finger engaging portions on the closure comprising flat surfaces adjacent the lower portion of the peripheral wall for holding the container and squeezing the skirt.

6. The squeeze and turn child resistant package set forth in claim 1 wherein said chordal lugs are hinged to the inner surface of the skirt along a vertical axis and a horizontal axis.

7. The child resistant package set forth in claim 1 wherein said closure has an inner annular wall supporting said thread means.

8. The squeeze and turn package set forth in any one of claims 1–7 wherein said container has a shoulder below said finish and said abutments are on said shoulder.

9. The squeeze and turn package set forth in any one of claims 1–7 wherein said container has a neck below said thread means, a flange on said neck, and said abutments are on said flange.

10. A container for a squeeze and turn package comprising a plastic container having a finish, said container finish having an external thread thereon, said container having opposed radially extending abutments, each abutment including a radial abutting surface, said finish of said container including an integral radial projection adjacent said radial abutting surface of said abutment, each said abutment having a radially and an axially engaging abutting surface, said radial projection having a lesser radial extent than said abutment, each said radial projection including a chordal surface intersecting said abutting surface at a right angle, said radial projection having a circumferential outwardly arcuate surface extending to the chordal surface of said radial abutting surface of said finish.

11. The container set forth in claim 10 wherein said container has an axial stop extending downwardly from said threads of said finish and including an axial surface.

12. The container set forth in claim 10 wherein said container has a non-circular body portion and a circular finish, said downwardly extending axial stops outwardly of said finish and extending downwardly from the threads thereof, each said stop including an axial surface.

13. The container set forth in claim 12 wherein the configuration of said body of the container is generally oval and has a long axis and a short axis and has opposed vertical flat surfaces on the long axis.

14. The container set forth in any one of claims 10–13 wherein said container has a shoulder below said finish and said abutments are on said shoulder.

15. The container set forth in any one of claims 10–13 wherein said container has a neck below said thread means, a flange on said neck, and said abutments are on said flange.

* * * * *